United States Patent [19]

Bogner

[11] Patent Number: 5,024,457

[45] Date of Patent: Jun. 18, 1991

[54] SAFETY SKI BINDING

[75] Inventor: Martin Bogner, Ostfildern, Fed. Rep. of Germany

[73] Assignee: GEZE Sport International GmbH, Leonberg, Fed. Rep. of Germany

[21] Appl. No.: 469,600

[22] PCT Filed: Aug. 3, 1989

[86] PCT No.: PCT/EP89/00922

§ 371 Date: Mar. 26, 1990

§ 102(e) Date: Mar. 26, 1990

[87] PCT Pub. No.: WO90/01358

PCT Pub. Date: Feb. 22, 1990

[51] Int. Cl.[5] ..... A63C 9/084

[52] U.S. Cl. ..... 280/632; 280/634

[58] Field of Search ..... 280/623, 626, 631, 632, 280/633, 634

[56] References Cited

FOREIGN PATENT DOCUMENTS

| | | | |
|---|---|---|---|
| 384952 | 2/1988 | Austria . | |
| 0094675 | 11/1983 | European Pat. Off. | 280/631 |
| 0189562 | 8/1986 | European Pat. Off. . | |
| 3128778 | 2/1983 | Fed. Rep. of Germany . | |
| 3406983 | 12/1985 | Fed. Rep. of Germany . | |
| 3601887 | 8/1986 | Fed. Rep. of Germany | 280/632 |
| 2602689 | 2/1988 | France | 280/632 |
| 417433 | 2/1967 | Switzerland . | |

*Primary Examiner*—Charles A. Marmor
*Assistant Examiner*—Brian L. Johnson
*Attorney, Agent, or Firm*—Townsend and Townsend

[57] ABSTRACT

In a safety ski binding with a heel unit which includes a bearing housing (11), a sole holder (13), a hand opening lever (15) and a release spring (16), an actuating abutment (22) is arranged on the sole holder (13) at a distance (A) from the first transverse axle (12) which is substantially smaller than the distance (B) of the culmination point from the first transverse axle (12). Moreover, a counter-abutment (23) which cooperates with the actuating abutment (22) is provided on the hand opening lever (15), with one of the two abutments (22, 23) being made resiliently yielding. Through cooperation of the two abutments (22, 23) the sole holder (13) pivots at a higher speed than the hand opening lever (15) into its open position. As a result the horizontal sliding section (32) enters into engagement again with the latch projection (17) shortly before reaching the culmination point (21), so that the further pivoting is only possible under compression of the resilient abutment. After exceeding the culmination point (21) the resilient abutment, together with the release spring (16), brings about the full opening of the sole holder (13).

14 Claims, 4 Drawing Sheets

SAFETY SKI BINDING

BACKGROUND OF THE INVENTION

The invention relates to a safety ski binding with a heel unit.

DESCRIPTION OF THE PRIOR ART

A safety ski binding of this kind is known from CH-PS 417 433. In order to move this known heel unit by hand from its closed position into an open position the hand opening lever is pressed downwardly against the bias force of the release spring, whereby the latch projection is brought out of the pivotal range of the culmination point of the cam track and the sole holder can be pivoted upwardly free of force. This intentional pivoting of the sole holder into the open position can either be brought about by lifting the heel region of the ski boot or, when the ski boot is not in engagement with the ski binding, by hand. In order to facilitate the intentional upward pivoting of the sole holder into its open position it is also known to provide an additional opening spring which acts on the sole holder and exerts a small bias force in the direction towards the open position of the sole holder.

With this arrangement it is disadvantageous that an additional component is necessary in the form of an opening spring which requires additional installation costs and is sensitive to corrosion.

SUMMARY OF THE INVENTION

The invention is based on the object of providing a heel unit for a safety ski binding in which, despite simple and cost-favorable, construction, the sole holder can be reliably pivoted into its open position.

During the opening movement, as a result of this construction, the hand opening lever initially leads the sole holder which remains in the close position until the actuating abutment and the counter-abutment come into engagement, whereupon the sole holder pivots into the opening direction and indeed faster than the hand opening lever as the culmination point moves ever closer to the latch projection until the latch projection again enters into engagement with the cam track shortly before reaching the culmination point. The further pivotal movement of the hand opening lever would now be blocked by the abutments which operate between the hand opening lever and the sole holder if these abutments, or at least one of them, were not made resilient. The further pivoting of the hand opening lever until the latch projection slides over the culmination point is however possible while compressing the resilient abutments, whereby an additional bias force is generated which acts directly on the sole holder and brings about a turning moment in the direction towards its open position. As soon as the latch projection has exceeded the culmination point the resilient abutments or resilient abutment relax(es), and the sole holder snaps into its open position on releasing the hand opening lever.

In this way no additional opening spring is necessary between the housing and the sole holder, whereby the heel unit can be manufactured more simply and at more favorable cost. Moreover, in the closed position of the sole holder there is advantageously no force—not even a small force which acts in the direction of the opening position so that the bias force of the release spring is not falsified.

An advantageous embodiment of the invention is characterized in that the distance between the first transverse axle and the culmination point amounts to 1.5 to 4 times, preferably 2 to 3 times and in particular 2.5 times the distance between the point of action of the actuating abutment and the first transverse axle. With such dimensioning of the distances particularly favorable force and speed conditions are present between the sole holder and the hand opening lever.

Further advantageous embodiments of the invention are evident from the subordinate claims.

BRIEF DESCRIPTION OF THE DRAWINGS

The invention will now be explained in the following by way of example and with reference to the drawing in which are shown.

DESCRIPTION OF THE PREFERRED EMBODIMENTS

Figure 1:
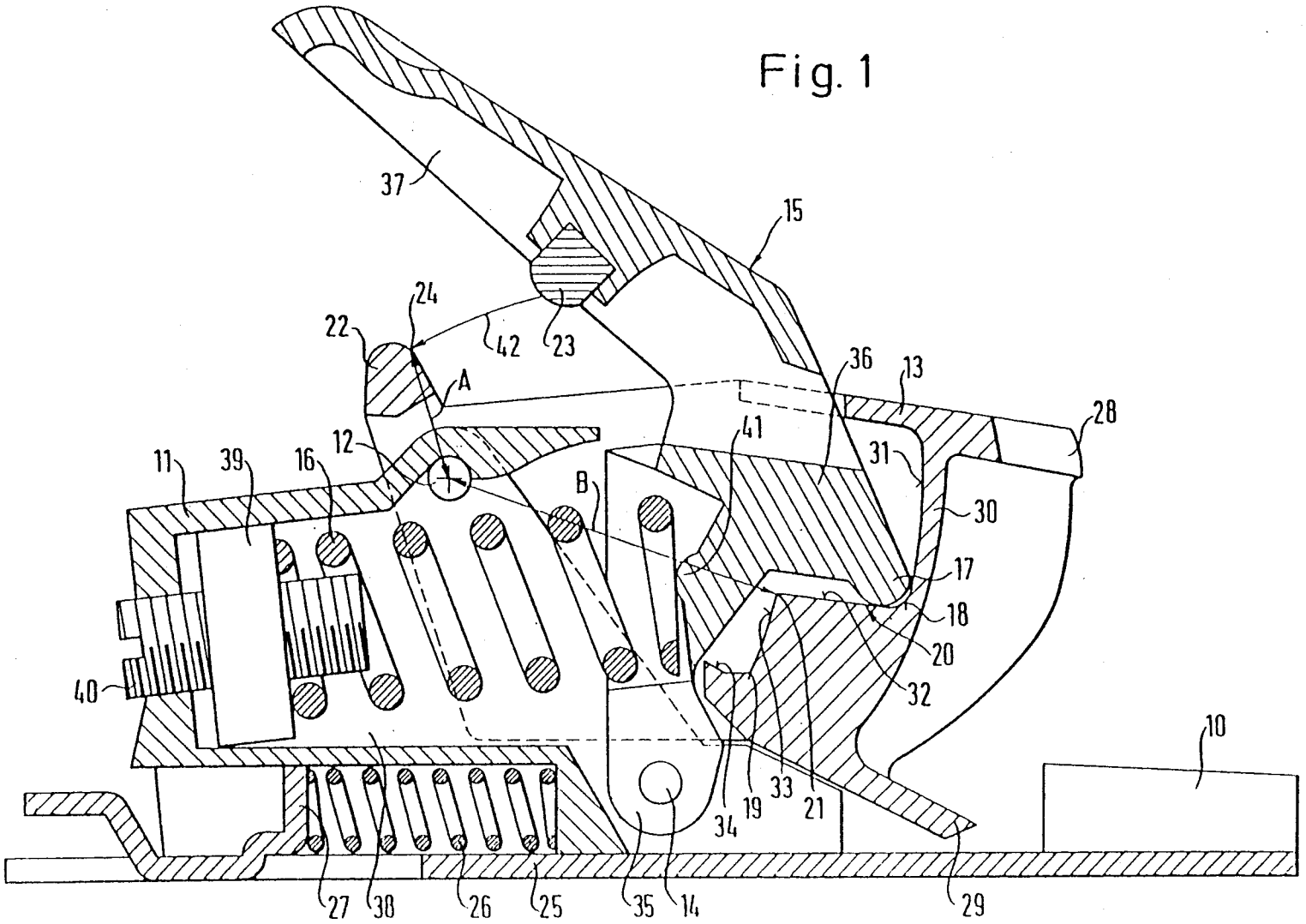
FIG. 1 a partly sectioned side view of a heel unit in the closed position.

FIG. 1 shows a heel unit which includes a bearing housing 11, a sole holder 13, a hand opening lever 15 and a release spring 16.

The bearing housing is longitudinally displaceably secured to a base plate 25 which is fixedly arranged on the surface of a non-illustrated ski. A thrust spring 26 acts at one end on the bearing housing 11 in the axial direction while its other end contacts an axial abutment 27 fixed to the base plate 25. This thrust spring 26 supports the bearing housing towards the rear and on inserting the ski boot into the ski binding brings about an axial thrust force on the sole of the ski boot in the direction towards a non-illustrated toe unit. Through the resilient support of the heel unit in the axial direction it is possible to compensate for a change of the spacing between the heel unit and the toe unit which can occur during bending of the ski, for example when passing over ground undulations.

A horizontal first transverse axle 12 is arranged in the upper region of the bearing housing 11 perpendicular to the longitudinal direction of the ski and the sole holder 13 is pivotally journalled around the first transverse axle. This first transverse axle 12 is provided close to the rear end of the sole holder 13.

The sole holder 13, has at its front end which faces the toe unit, a sole hold down clamp 28 at the top, at the bottom a tread spur 29 and therebetween a front terminal wall 30 which cooperate with the heel part of a non-illustrated sole of a ski boot. The sole of the ski boot lies, when the ski boot is inserted, on a tread plate 10 which is secured to the base plate 25.

A cam track 20 with a substantially vertical top or zipper portion 31, a horizontal slide portion 32, a vertical slide portion 33 and a substantially horizontal lower portion 34 is provided at the side of the terminal wall 30 facing the first transverse axle 12. Between the upper portion 31 and the horizontal slide portion or section 32 there is located a first latch recess 18 and between the vertical slide portion 33 and the lower portion 34 there is located a second latch recess 19, while a knee-like projection having a culmination point 21 and directed towards the transverse axle 12 is formed at the transition from the horizontal slide portion 32 into the vertical slide portion 33.

Above and fractionally behind the first transverse axle 12 the sole holder 13 has a cam-like actuating abutment 22 which projects upwardly beyond the sole holder 13 and is formed in one piece with the latter.

The hand opening lever 15 is connected to the bearing housing 11 and pivotally journalled on the latter via a second transverse axle 14 which extends parallel to the first transverse axle 12. This second transverse axle 14 is located in the region of the bearing housing 11 close to the base plate and lies in the axial direction approximately at the middle between the first transverse axle 12 and the first latch recess 18. The hand opening lever 15 is made in one piece and comprises a lower bearing region 35 which receives the second transverse axle 14, a central force transmitting region 36 and an upper press-down actuating region 37 which is angled fractionally to the rear. In the force transmitting region 36 the hand opening lever 15 has a latch projection 17 which is directed towards the toe unit and which, in the closed position of the sole holder 13 latches into the first latch recess 18 of the cam track 20 in order to exert a hold-down force onto the sole holder 13 which holds the ski boot on the ski.

The force which holds the sole holder 13 in its closed position, and in its open position, is generated by the release spring 16 which is arranged in an axial central opening 38 of the bearing housing 11. The rear end of the release spring 16 lies against an adjustment washer 39 which is braced at the rear against the bearing housing 11 and which is displaceable by means of an adjustment screw 40 in the axial direction in order to adjust the required bias. The front end of the release spring 16 contacts a rear hemispherical cam 41 of the hand opening lever 15 which is arranged at substantially the same level as the latch projection 17. In this way the release spring 16 generates a turning moment which acts in the clockwise sense about the second transverse axle 14 and which is transferred via the latch projection 17 onto the sole holder 13 and urges the latter in the direction towards its closed position.

A resilient counter-abutment 23 is arranged at the bottom of the actuating region 37 of the hand opening lever 15 which moves downwardly during an opening movement so that on pivoting of the hand opening lever 15 in the direction of the arrow 42, and with the sole holder 13 remaining in the closed position, the counter-abutment comes into contact with the actuating abutment 22 at the point of action 24.

The functional sequence on manual opening of the heel unit out of its closed position will now be described:

In the closed position the hand opening lever 15 is located under the action of the release spring 16 in its frontmost position in which the latch projection 17 is pressed into the first latch recess 18 of the cam track 20 and thus holds the sole holder 13 in the close position.

If now the hand opening lever 15 is pivoted in the direction of the arrow 42 while compressing the release spring 16 up to the actuating abutment 22 then the latch projection 17 first moves away from the first latch recess 18 and also lifts away from the upper section and the horizontal slide section 32 of the cam track 20. In this state the sole holder 13 is decoupled from the bias force of the release spring 16, remains however in its closed position due to its weight.

During further downward pivoting of the hand opening lever 15 into its open position the counter-abutment 23 is in engagement with the actuating abutment 22 and exerts a force on the latter in the direction of the arrow 42 whereby the actuating abutment 22 pivots rearwardly and thus the sole holder 13 is pivoted upwardly about the first transverse axle 12. As the distance A of the point of action 24 from the transverse axle 12 is substantially smaller than the distance B of the transverse axle 12 from the culmination point 21, or smaller than the distance of the transverse axle 12 from the latch recess 18, and as the latch projection 17 is already located in a region close to the zenith of its pivot circle around the second transverse axle 14, the horizontal slide portion 32 moves upwardly substantially faster than the latch projection 17, so that the horizontal slide portion 32 of the sole holder 13 again approaches the latch projection 17.

This approach is however favored by the fact that the culmination point 21 located at the end of the horizontal slide portion 32 is arranged at a distance B from the first transverse axle 12 which is approximately 2.5 times the distance A between the point of action 24 of the actuating abutment 22 with the counter-abutment 23 and the first transverse axle 12. For the same angular speed the culmination point 21 thereby travels a substantially larger path along its pivot circle about the first transverse axle 12 than the point of action 24, namely 2.5 times the distance. As the further points of the horizontal slide portion 32 are still further removed from the first transverse axle 12 this also applies to an even greater degree for all remaining points on the horizontal slide portion 32.

At the end of this approach phase the horizontal slide portion 32 enters again into engagement with the latch projection 17 shortly before the culmination point 21. Further pivoting of the hand opening lever 15 is now only possible in that the resilient counter-abutment 23 is compressed, as can be seen from FIG. 2. The release spring 16 is compressed together until the latch projection 17 reaches the culmination point 21 and thus its dead position in which, on releasing the hand opening lever 15, the sole holder 13 would be pivoted neither into its close position nor into its open position.

With a small further pivoting of the hand opening lever 15 the sole holder 13 springs into an over dead center position in which the latch projection 17 enters into engagement with the vertical slide portion 33. In this position a further actuation of the hand opening lever 15 is no longer necessary since the actuating abutment 22 and thus the entire sole holder 13 is pivoted on further about the first transverse axle 12 through the relaxation of the resilient counter-abutment 23 which now takes place. The release spring 16 thereby presses the latch projection 17 against the vertical slide portion 33, whereby a force is likewise exerted in the vertical direction and thus a torque is exerted in the counter-clockwise sense about the first transverse axle 12 which pivots the sole holder 13 into its open position.

Figure 3:
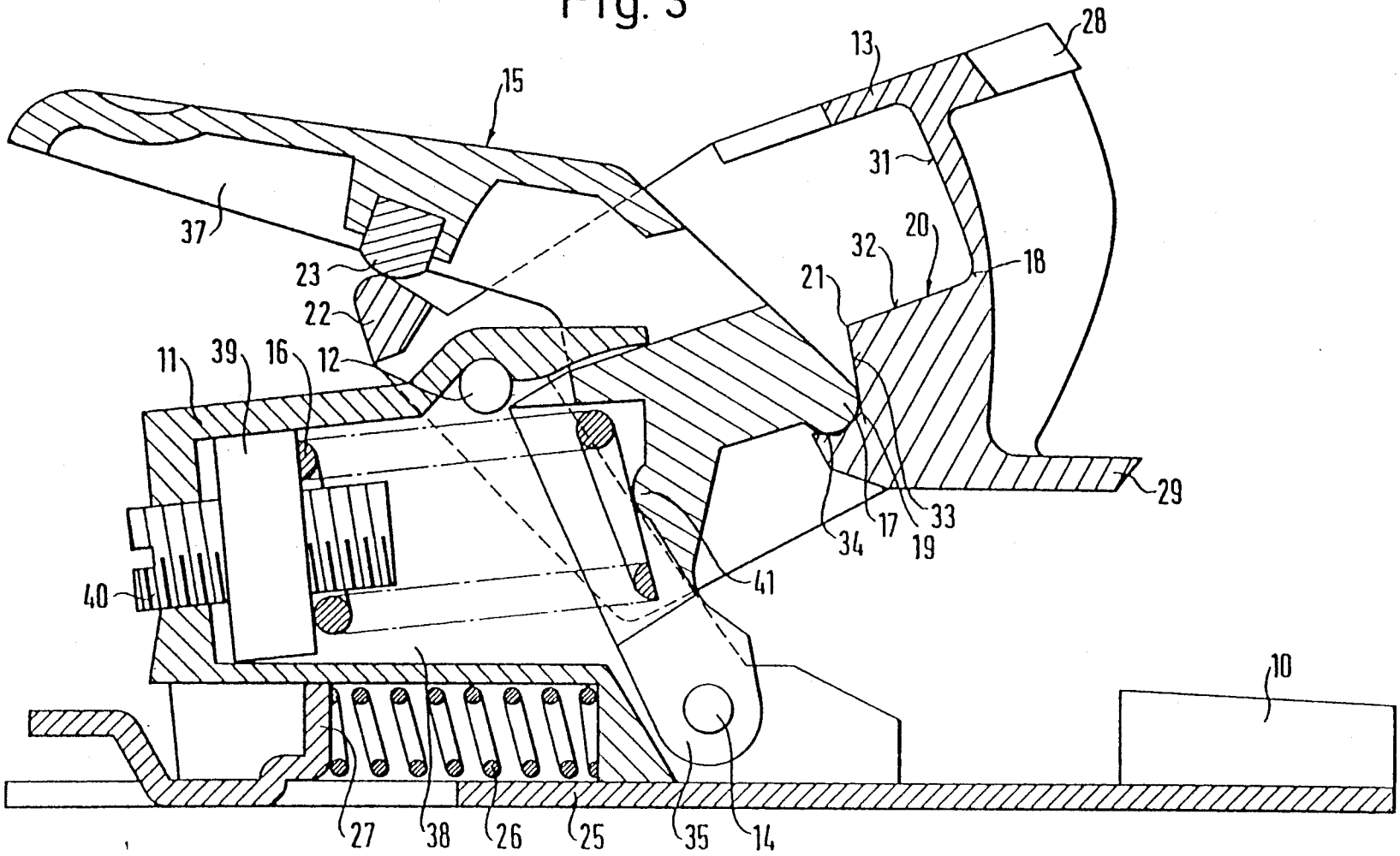

The open position can be seen from FIG. 3. In this open position the latch projection 17 engages into the second latch recess 19 of the cam track 20, so that the sole holder 13 is latched in the open position. The resilient counter-abutment 23 is again relaxed in this position.

The automatic opening of the heel binding during a fall takes place in substantially the same manner as during hand release. In distinction to the hand release the force for the pivoting of the hand opening lever 15 up to the pertainment of the over dead center position is not introduced via the press-down region 37 of the hand opening lever 15 but rather via the horizontal slide portion 32 of the cam track 20 which presses the latch projection 17 of the hand opening lever 15 upwardly.

As a result of this changed introduction of the force the latch projection 17 does not lift from the horizontal slide portion 32 during the first phase of the pivotal movement but rather slides on the latter up to the culmination point 21.

The further opening then takes place in the same manner as during hand release.

The actuating abutment 22 can also be made resilient in place of the counter-abutment 23. Spring abutments can consist of rubber of another material which has the required resilient characteristics. In particular a compression spring can be provided in place of a rubber element.

The determining fact is that the latch projection 17 of the hand opening lever 15 lies in the pivotal range of the horizontal slide portion 32 of the cam track 20 when the counter-abutment 23 and the actuating abutment 22 are not pressed together, whereby the further pivotal movement of the hand opening lever 15 and of the sole holder 13 into the open position is first blocked while the latch projection 17 can be brought by compression of the resilient abutment via the culmination point out of the pivotal range of the horizontal slide portion 32, so that the latch projection 17 can slide into the over dead center position of the cam track 20. In this position the further pivotal movement of the sole holder 13 into its open position is brought about initially by the pressure force of the resilient abutment 23 and then by the thrust force of the release spring 16 after releasing the hand opening lever 15.

In order that the pivotal movement of the hand opening lever 15 and of the sole holder 13 can be blocked in the open position shortly before the culmination point 21 it is necessary for the horizontal portion 32 of the cam track 20 to be pivoted with a greater track speed than the latch projection 17 of the hand opening lever in the same track direction, so that the leading latch projection 17 can be caught up by the trailing horizontal slide portion 32 and can reenter into engagement with the latter.

Figure 2:
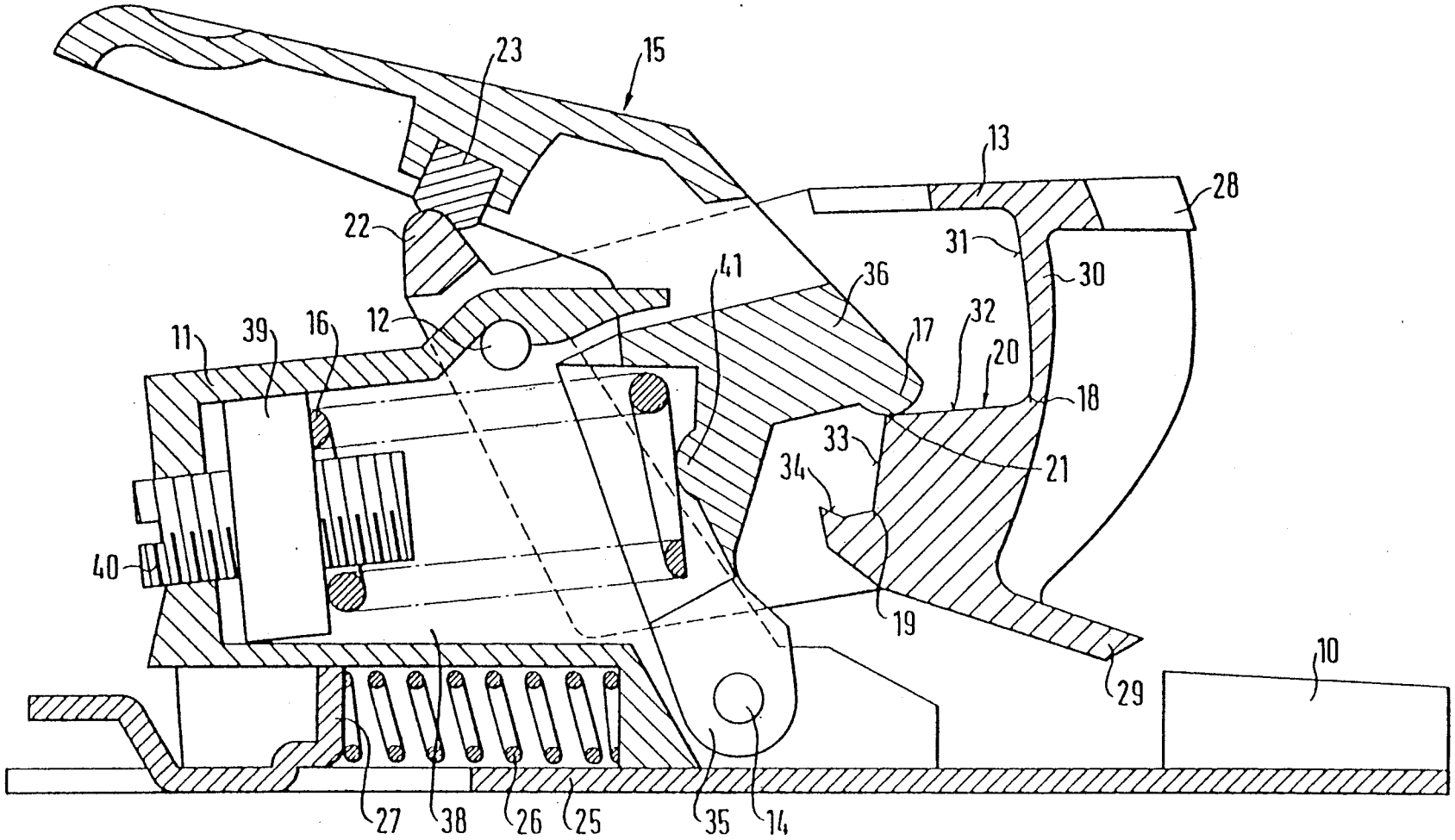
FIG. 2 a side view of the heel unit in a half open position shortly before reaching the culmination point, FIG. 3 a side view of the heel unit in the open position, FIG. 4 a schematic side view of a second embodiment of the heel unit in a half open position shortly before reaching the culmination point.
Figure 4:
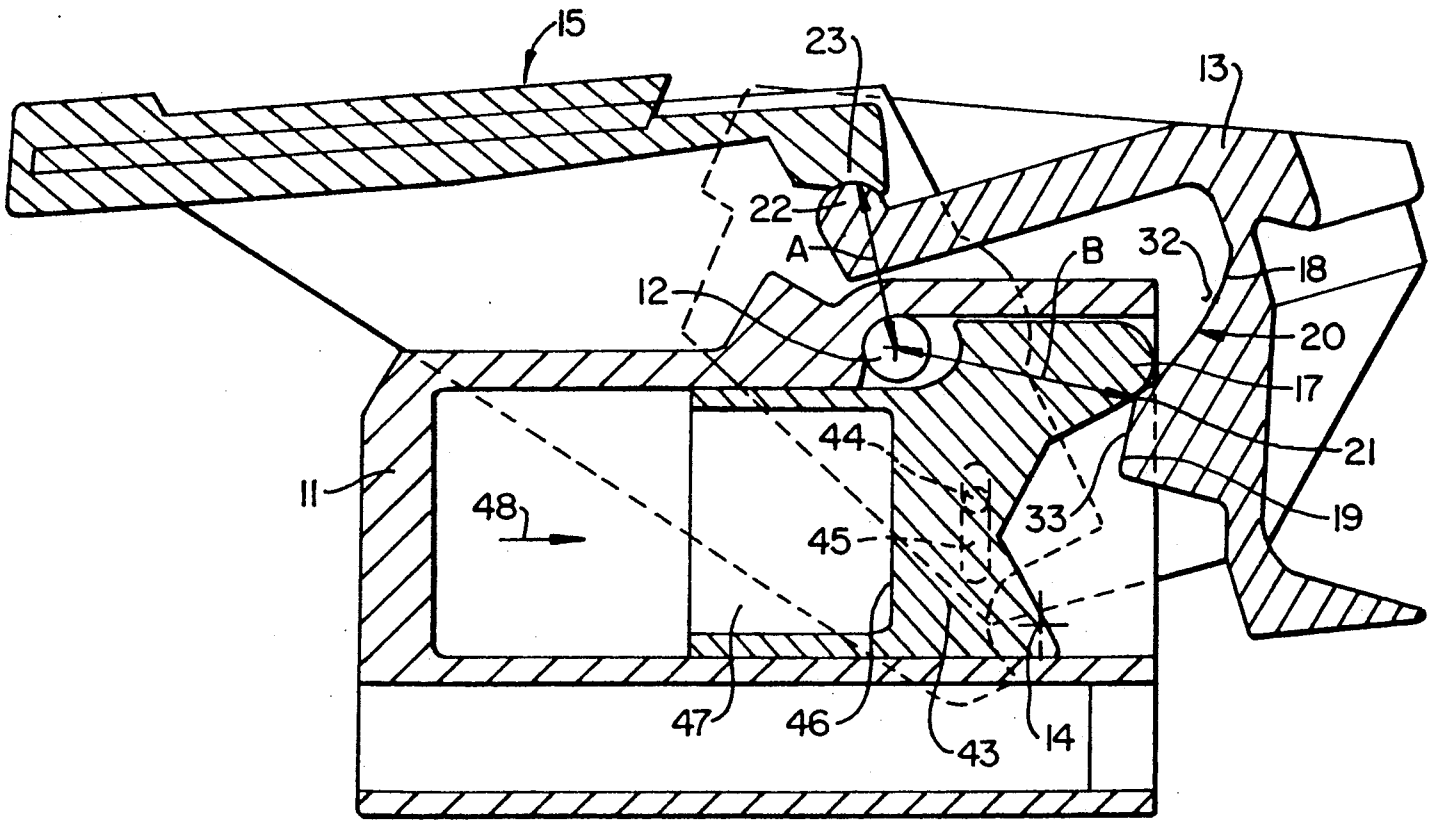

FIG. 4 shows a variant of the heel unit in which the same parts are provided with the same reference numerals as in FIGS. 1 to 3.

In this embodiment the latch projection 17 is not formed in one piece with the hand opening lever 15 but rather a latch element 43 is provided which is axially displaceably guided inside the bearing housing 11.

The latch element 43 has a transverse spigot 44 which engages into a vertical elongate slot guide 45 provided in the hand opening lever 15, so that a fixed and predetermined positional relationship exists between the angular position of the hand opening lever 15 and the position of the latch element 43. Several transverse spigots 44 could also be provided, i.e. arranged at both sides of the latch element 43, with these transverse spigots engaging into correspondingly arranged elongate slot guides 45 of the hand opening lever. Furthermore, it is likewise possible to arrange the transverse spigot(s) 44 on the hand opening lever 15 and the elongate slot guide(s) on the latch element 43.

The release spring which is not shown in FIG. 4 is not braced against the hand opening lever 15 as in the embodiments of FIGS. 1 to 3, but rather against the latch element 43. One end of the release spring contacts an end face 46 of a recess 47 of the latch element 43 while its other end is braced in the same manner as in FIGS. 1 to 3 against the bearing housing 11, or against the adjustment washer 39 which is not shown in FIG. 4.

The latch element 43 is continuously urged by means of the release spring in the direction of the arrow 48 so that the latch projection 17 which is formed in one piece with the latch element 43 depresses the sole clamp 13 into the closing direction when the latch projection 17 is located in the region of the horizontal slide portion 32. The hand opening lever 15 is thereby likewise biased via the transverse spigot 44 and the elongate slot guide 45 into its closed position in which it adopts its steepest position, i.e. most upwardly directed position.

The manual transfer of the sole holder 13 from its closed position into an open position via the hand opening lever 15 takes place in the same manner as in the embodiment of FIGS. 1 to 3. The latch projection 17 can thus only be brought from its horizontal slide portion 32 via the culmination point 21 to its vertical slide portion 33 in that either the actuating abutment 22 or the counter-abutment 23 is compressed, whereby a further angular movement of the hand opening lever 15 and thus a further horizontal displacement of the latch projection 17 is possible against the direction the arrow 42, as in FIG. 1.

As the latch projection 17 is not provided on the hand opening lever 15, but rather on the latch element 43, the latch projection 17, in distinction to the first embodiment, does not execute a circular movement about the second transverse axle 14, but rather a pure translational movement against the direction of the arrow 48.

In the open position the latch projection 17 contacts the vertical slide portion 33 of the cam track 20 and thereby holds the sole holder 13 in the open position.

REFERENCENUMERALLIST

10 Tread plate
43 Latch element
11 Bearing housing
44 Transverse spigot
12 First transverse axle
45 Elongate guide
13 Sole holder
46 End face
14 Second transverse axle
47 Recess
15 Hand opening lever
48 Arrow
16 Release spring
17 Latch projection
18 First latch recess
19 Second latch recess
Special positions
20 Cam track
A: Distance
21 Culmination point
B: Distance
22 Actuating abutment
23 Counter-abutment
24 Point of action
25 Base plate 26 Thrust spring
27 Axial abutment
28 Sole hold-down clamp
29 Tread spur
30 Terminal wall
31 Upper portion
32 Horizontal slide portion
33 Vertical slide portion
34 Lower portion
35 Bearing region
36 Force transmitting region
37 Actuating region
38 Central opening
39 Adjustment washer
40 Adjustment screw
41 Cam
42 Arrow

I claim:

1. Safety ski binding comprising a heel unit having a bearing housing (11) which is secured to the ski and is preferably displaceable rearwardly against a spring force, with a sole holder (13) capable of pivoting between a closed position and an open position about a first transverse axle (12) connected to the bearing housing and with a hand opening lever capable of pivoting between a close position and an open position about a second transverse axle (14) connected to the bearing housing, wherein a release spring (16) which is braced having one end against the bearing housing (11) and which biases a hand opening lever (15) to a closed position in a closing direction relative to the second axle provided in the bearing housing and a.latch projection (17) is movable by means of the hand opening lever (15) and engages in the closed position into a first latch recess (18) and in an open position into a second latch recess (19) of a cam track (20) arranged on the sole holder (13) and provides for latching of the sole holder in the closed position and in the open position, with the cam track (20) having a culmination point (21) between the first latch recess and the second latch recess, characterized in that: an actuating abutment (22) is arranged on the sole holder (13) at a distance (A) from the first transverse axle (12) which is clearly smaller than a distance (B) of the culmination point (21) from the first transverse axle (12); in that a counter-abutment (23) which cooperates with the actuating abutment (22) is provided on the hand opening lever (15); in that at least one of the two abutments (22, 23) is made resiliently yielding; and in that the hand opening lever (15) is pivotally arranged on the bearing housing (11) relative to the sole holder (13), and the counter-abutment (23) is attached thereto, such that when the sole holder (13) is located in the closed position and when the hand opening lever is moved from the closed position into an open position, said hand opening lever first engages the actuating abutment (22) and then moves the sole holder (13) in the opening direction with an angular speed in relation to the first transverse axle (12) which is increased relative to the actual angular speed of the hand opening lever (15), in correspondence to the different distances (A, B) and the instantaneous phase of a circular movement of the hand opening lever (15), until the latch projection again contacts the cam track (20) prior to reaching the culmination point (21), whereupon the latch projection (17) slides with compression of the at least one resilient abutment over the culmination point (21) and the sole holder (13) springs into an over dead point position, wherein the counter-abutment (23) is resilient and the actuating abutment (22) is rigid.

2. Safety ski binding in accordance with claim 1, characterized in that, with a closed sole holder (13), the first transverse axle (12) is arranged in the upper region of the sole holder (13) and the culmination point (21) in the closed position of the sole holder (13) is arranged lower than the first transverse axle (12) while the actuating abutment (22) is provided substantially above the first transverse axle (12).

3. Safety ski binding in accordance with claim 1, characterized in that the second transverse axle (14) is arranged beneath the first transverse axle (12) and beneath the culmination point (21) and, in the longitudinal direction of the ski, between the first transverse axle (12) and the culmination point (21).

4. Safety ski binding in accordance with claim 1, characterized in that the first latch recess (18) is arranged in the closed position in the vertical direction approximately in the middle between the first transverse axle (12) and the second transverse axle (14), and the second latch recess (19) is arranged in the open position approximately at the same level as the first transverse axle (12).

5. Safety ski binding in accordance with claim 1, characterized in that the distance (B) between the first transverse axle (12) and the culmination point (21) amounts to approximately 1.5 to 4 times, the distance (A) between the point of action (24) of the actuating abutment (22) and the first transverse axle (12).

6. Safety ski binding in accordance with claim 1, characterized in that the actuating abutment (22) is arranged on a side remote from the cam track (20) of the first transverse axle (12) of the sole holder (13).

7. Safety ski binding in accordance with claim 1, characterized in that the counter-abutment (23) is formed as a rubber spring.

8. Safety ski binding in accordance with claim 1, characterized in that the latch projection (17) is arranged on a latch element (43) separate from the hand opening lever (15) and the release spring (16) is braced against the latch element (43) which is displaceable within the bearing housing (11) by means of the hand opening lever (15) that a predetermined positional relationship exists between the angular position of the hand opening lever (15) and the position of the latch element (43).

9. Safety ski binding in accordance with claim 8, characterized in that at least one transverse spigot (44) is secured to the latch element (43) and engages into at least one elongate slot guide (45) provided in the hand opening lever (15).

10. Safety ski binding in accordance with claim 8, characterized in that the latch element (43) is displaceably guidably arranged in the axial direction of the bearing housing (11).

11. Safety ski binding in accordance with claim 1, characterized in that the distance (B) between the first transverse axle (12) and the culmination point (21) amounts to approximately 2 to 3 times the distance (A) between the point of action (24) of the actuating abutment (22) and the first transverse axle (12).

12. Safety ski binding in accordance with claim 1, characterized in that the distance (B) between the first transverse axle (12) and the culmination point (21) amounts to approximately 2.5 times the distance (A) between the point of action (24) of the actuating abutment (22) and the first transverse axle (12).

13. Safety ski binding in accordance with claim 1, characterized in that the latch projection (17) is arranged on the hand opening lever (15) and the release spring (16) is braced at the hand opening lever (15) which is pivotable within the bearing housing (11) by means of the hand opening lever (15) that a predetermined positional relationship exists between the angular position of the hand opening lever (15) and the position of the latch element (43).

14. Safety ski binding in accordance with claim 8, characterized in that at least one transverse spigot (44) is secured to the hand opening lever (15) and engages into at least one elongate slot guide (45) provided in the latch element (43).

* * * * *